US009008348B1

(12) United States Patent
Kallen et al.

(10) Patent No.: US 9,008,348 B1
(45) Date of Patent: Apr. 14, 2015

(54) LOW PROFILE LOUDSPEAKER

(71) Applicants: Drew Kallen, Gilbert, AZ (US); James C. Strickland, Mesa, AZ (US)

(72) Inventors: Drew Kallen, Gilbert, AZ (US); James C. Strickland, Mesa, AZ (US)

(73) Assignee: Rockford Corporation, Tempe, AZ (US)

( * ) Notice: Subject to any disclaimer, the term of this patent is extended or adjusted under 35 U.S.C. 154(b) by 0 days.

(21) Appl. No.: 14/147,327

(22) Filed: Jan. 3, 2014

(51) Int. Cl.
*H04R 25/00* (2006.01)
*H04R 15/00* (2006.01)

(52) U.S. Cl.
CPC ..... *H04R 15/00* (2013.01)

(58) Field of Classification Search
CPC ..... H04R 9/025; H04R 9/04; H04R 7/16; H04R 7/18; H04R 9/02; H04R 9/041; H04R 9/045; H04R 9/06
USPC ..... 381/400, 401, 403, 404, 405, 407, 396, 381/397, 398, 420, 421
See application file for complete search history.

(56) References Cited

U.S. PATENT DOCUMENTS

| | | | | | |
|---|---|---|---|---|---|
| 3,609,253 | A | | 9/1971 | Ashworth | 179/115.5 R |
| 3,792,394 | A | | 2/1974 | Bertagni | 335/299 |
| 4,190,746 | A | | 2/1980 | Harwood et al. | 179/115.5 R |
| 4,327,257 | A | | 4/1982 | Schwartz | 179/115.5 R |
| 5,081,684 | A | * | 1/1992 | House | 381/420 |
| 5,734,132 | A | | 3/1998 | Proni | 181/171 |
| 5,883,967 | A | | 3/1999 | House | 381/398 |
| 6,095,280 | A | | 8/2000 | Proni | 181/171 |
| 6,526,151 | B1 | | 2/2003 | Peng | 381/403 |
| 6,675,931 | B2 | | 1/2004 | Sahyoun | 181/157 |
| 6,836,551 | B2 | | 12/2004 | Kuze et al. | 381/412 |
| 6,842,529 | B2 | | 1/2005 | Koura et al. | 381/403 |
| 6,865,282 | B2 | | 3/2005 | Weisman | 381/404 |
| 7,155,028 | B2 | | 12/2006 | Lin | 381/407 |
| 7,433,485 | B1 | | 10/2008 | Diedrich et al. | 381/404 |
| 7,724,913 | B2 | | 5/2010 | Ohara | 381/404 |
| 7,856,115 | B2 | | 12/2010 | Clair et al. | 381/404 |
| 8,290,199 | B2 | | 10/2012 | Pircaro | 381/398 |
| 8,311,263 | B2 | | 11/2012 | Huang | 381/404 |
| 2004/0190747 | A1 | | 9/2004 | Chikama | 381/401 |
| 2011/0044491 | A1 | | 2/2011 | Ku et al. | 381/433 |
| 2011/0243364 | A1 | | 10/2011 | Walter | 381/397 |

FOREIGN PATENT DOCUMENTS

| | | | |
|---|---|---|---|
| DE | 3123098 | A1 | 1/1983 |
| JP | 59-077797 | | 4/1984 |
| JP | 04-003700 | | 1/1992 |
| JP | 2002345086 | A | 11/2002 |

* cited by examiner

*Primary Examiner* — Davetta W Goins
*Assistant Examiner* — Phylesha Dabney
(74) *Attorney, Agent, or Firm* — The Patent Source

(57) ABSTRACT

Disclosed loudspeakers include a frame, a magnetic yolk affixed to the frame, a voicecoil, a spider, a resilient surround, and a cone. The yoke includes a slotted sidewall and a central slug that form an air-gap. The voicecoil is within the gap and includes a former, with top and bottom edges, and at least one winding on the former. The voicecoil moves when receiving alternating electrical potentials. The spider has a flexible outer portion, has an inner portion with rigid members that always extend through the yolk slots, and is affixed to the former bottom edge. The cone includes an inner portion affixed to the former top edge and an outer portion affixed to the frame through the surround, wherein the inner portion includes rigid members capable of movement within the sidewall slots with movement of the voicecoil.

20 Claims, 9 Drawing Sheets

LOW PROFILE LOUDSPEAKER

BACKGROUND OF THE INVENTION

1. Field of the Invention

The present invention is directed to improvements in shallow depth audio loudspeakers. Accordingly, the general objects of the invention are to provide novel systems, methods, and/or apparatus such character.

2. Description of the Related Art

Permanent magnet/moving coil driven speakers have not significantly changed in over 50 years. These speakers (transducers) are based on the Lorentz Law which dictates that a conductive loop carrying current within a magnetic field creates an electromotive force from within the magnetic field. The mechanical elements of a loudspeaker depend on mechanical suspension spring constants and the corresponding losses.

The primary factor constraining the depth of a voice coil driven speaker is its suspension points. The cone surround and the spider are the two common suspension components. The surround attaches to the outer edge of a rigid cone body and is typically very compliant to accommodate the movement of the cone while stabilizing its motion. The spider is also at least partially compliant (often made of resin impregnated woven cotton, poly-cotton, or NOMEX™) and its primary function is to maintain the centering of the voice coil in the magnetic gap throughout motion of the moving assembly (cone, voice coil, spider, surround, lead wire). The spider and surround attachment points typically dictate the motional clearance of the moving assembly relative to the fixed motor/magnet assembly. This, in turn, drives the overall depth requirement.

One relatively recent development in the speaker art has been the introduction of the segmented/slotted magnetic yoke with complementary cones/spiders that may pass therethrough. Using such a structure it is possible to make speakers of a given specification that are much shallower in depth than might have been previously possible. Since low profile (shallow depth) speakers may be desirable (or even necessary) in certain applications, a number of such designs have been proposed. These include: U.S. Pat. No. 3,792,394 to Bertagni; U.S. Pat. No. 5,081,684 to House; U.S. Pat. No. 6,865,282 to Weisman; U.S. Pat. No. 8,290,199 to Pircaro; U.S. Pat. No. 4,190,746 to Harwood et al.; and U.S. Pat. No. 7,155,028 to Lin. These patents are hereby incorporated by reference in their entirety. While all of these designs have their advantages, no particular design is considered far superior to the others and additional developments/improvements remain available.

SUMMARY OF THE INVENTION

The present invention satisfies the above-stated needs and overcomes the above-stated and other deficiencies of the related art by providing low profile loudspeakers that provide desirable power handling capabilities in a form factor that is shallower than many conventional speakers.

One aspect of the present invention is directed to a low profile loudspeaker having a rigid frame, a magnetic yoke, a voicecoil, a resilient surround affixed to the frame, a spider, and a rigid cone. The magnetic yoke may be affixed to the rigid frame and may have a slotted sidewall and a central slug disposed within the slotted sidewall to thereby form an air-gap therebetween. At least one of the slotted sidewall and the central slug of the yoke may be permanently magnetic such that the sidewall and central slug form a magnetic circuit. The invention may also have a voicecoil that is at least partially disposed within the air-gap and has a generally cylindrical former, with top and bottom edges, inner and outer surfaces, and a first winding disposed on one of the inner and outer surfaces. The voicecoil may move within the air-gap in response to an alternating electrical potential being received by the first winding. The spider of the invention may have at least one flexible outer portion affixed to the rigid frame and a rigid inner portion affixed to the bottom edge of the voicecoil former. The inner portion of the spider may comprise an inner ring disposed between the slotted sidewall and the central slug of the yoke, an outer ring disposed outside of the slotted sidewall of the yoke, and plural rigid members coupling the inner ring to the outer ring and always extending through the sidewall slots. Finally, the rigid cone may have an inner portion affixed to the top edge of the voicecoil former and an outer portion affixed to the resilient surround. The cone inner portion may include a rigid inner ring capable of movement between the slotted sidewall and the central slug of the yoke, a rigid outer ring disposed outside of the slotted sidewall of the yoke, and plural rigid members coupling the inner ring to the outer ring, the rigid members being capable of movement within the sidewall slots in response to movement of the voicecoil.

In a related form the invention may take the form of a low profile loudspeaker having a rigid frame, a magnetic yoke, a voicecoil, a resilient surround affixed to the frame, first and second spiders, and a rigid cone. The magnetic yoke may be affixed to the rigid frame and may have a slotted sidewall and a central slug disposed within the slotted sidewall to thereby form an air-gap therebetween. At least one of the slotted sidewall and the central slug of the yoke may be permanently magnetic such that the sidewall and central slug form a magnetic circuit. The invention may also have a voicecoil that is at least partially disposed within the air-gap and has a generally cylindrical former, with top and bottom edges, inner and outer surfaces, and a first winding disposed on one of the inner and outer surfaces. The voicecoil may move within the air-gap in response to an alternating electrical potential being received by the first winding. The invention may also include a first spider having a flexible outer portion and a rigid inner portion having plural rigid members always extending through the sidewall slots. The first spider outer portion may be affixed between the frame and the inner portion and the inner portion may be affixed to the bottom edge of the voicecoil former. The invention may also have a flexible second spider affixed between the rigid frame and the rigid inner portion of the cone. Finally, the invention may include a rigid cone comprising an inner portion affixed to the top edge of the voicecoil former and an outer portion affixed to the resilient surround. The inner portion of the cone may have plural rigid members capable of movement within the sidewall slots in response to movement of the voicecoil.

In another related form the invention may include a low profile loudspeaker having a rigid frame, a magnetic yoke, a voicecoil, a resilient surround affixed to the frame, a dual-spider, and a rigid cone. The magnetic yoke may be affixed to the rigid frame and may have a slotted sidewall and a central slug disposed within the slotted sidewall to thereby form an air-gap therebetween. At least one of the slotted sidewall and the central slug of the yoke may be permanently magnetic such that the sidewall and central slug form a magnetic circuit. The invention may also have a voicecoil that is at least partially disposed within the air-gap and has a generally cylindrical former, with top and bottom edges, inner and outer surfaces, and a first winding disposed on one of the inner and outer surfaces. The voicecoil may move within the air-gap in response to an alternating electrical potential being received by the first winding. The invention may also include a dual spider having first and second flexible outer portions affixed between the rigid frame and a rigid inner portion The inner portion of the spider may be affixed to the bottom edge of the voicecoil former and have plural rigid members that always extend through respective ones of the sidewall slots. Finally, the invention may have a rigid cone with an inner portion affixed to the top edge of the voicecoil former and an outer portion affixed to the resilient surround for movement in response to movement of the voicecoil. The inner portion of this cone may have plural rigid members capable of movement within respective ones of the sidewall slots in response to movement of the voicecoil.

Numerous other advantages and features of the present invention will become apparent to those of ordinary skill in the art from the following detailed description of the preferred embodiments, from the claims and from the accompanying drawings.

BRIEF DESCRIPTION OF THE DRAWINGS

The preferred embodiments of the present invention will be described below with reference to the accompanying drawings wherein like numerals represent like steps and/or structures and wherein.

DETAILED DESCRIPTION OF THE PREFERRED EMBODIMENTS

Figure 1:
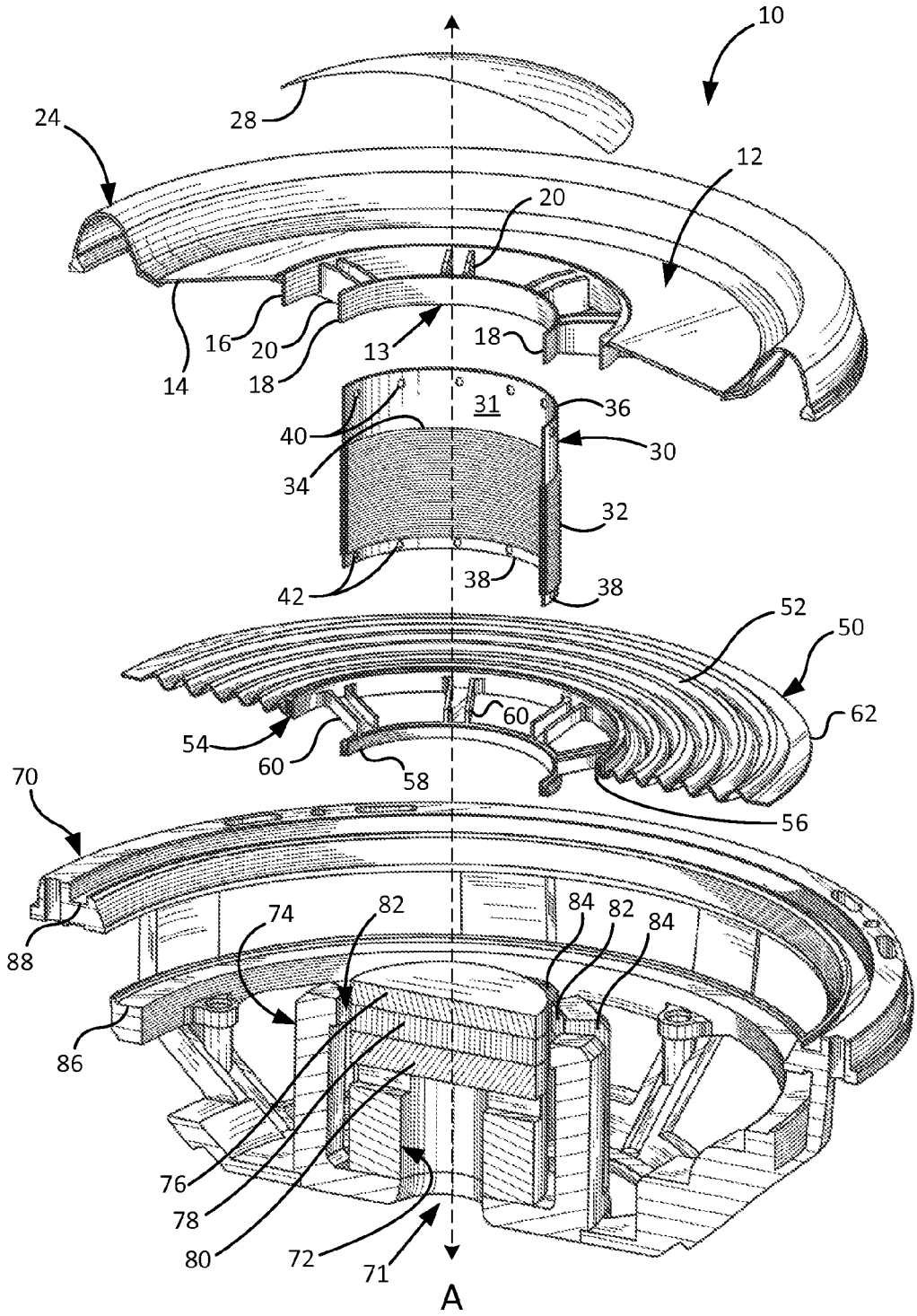
FIG. 1 is an exploded cut-away view of a low profile speaker in accordance with one preferred embodiment of the present invention.
Figure 2:
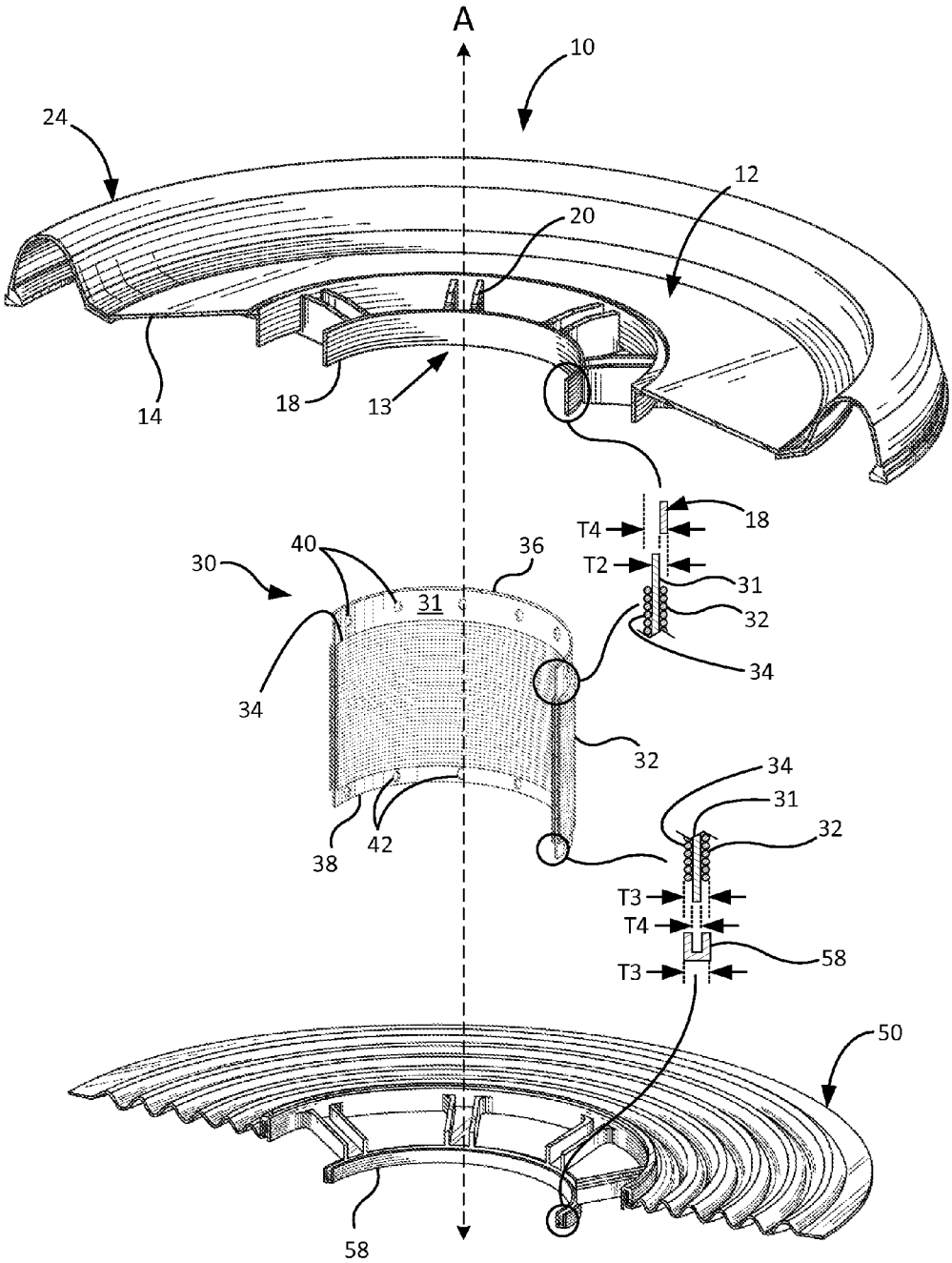
FIG. 2 is an exploded cut-away view of the cone, spider and voicecoil of the low profile speaker of FIG. 1.
Figure 3:
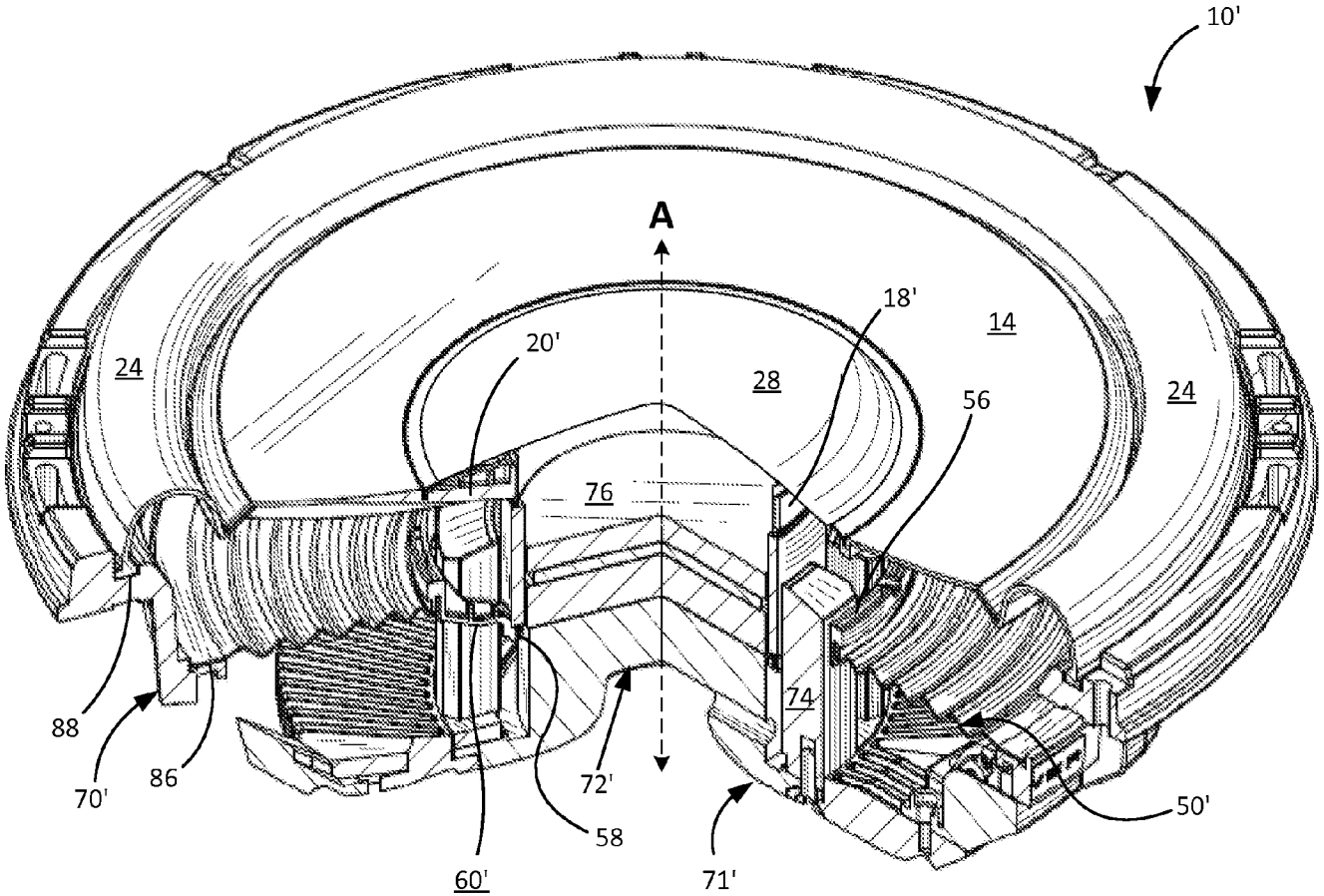
FIG. 3 is a non-exploded cut-away view of a low profile speaker in accordance with another preferred embodiment closely related to that of FIGS. 1 and 2.
Figure 4:
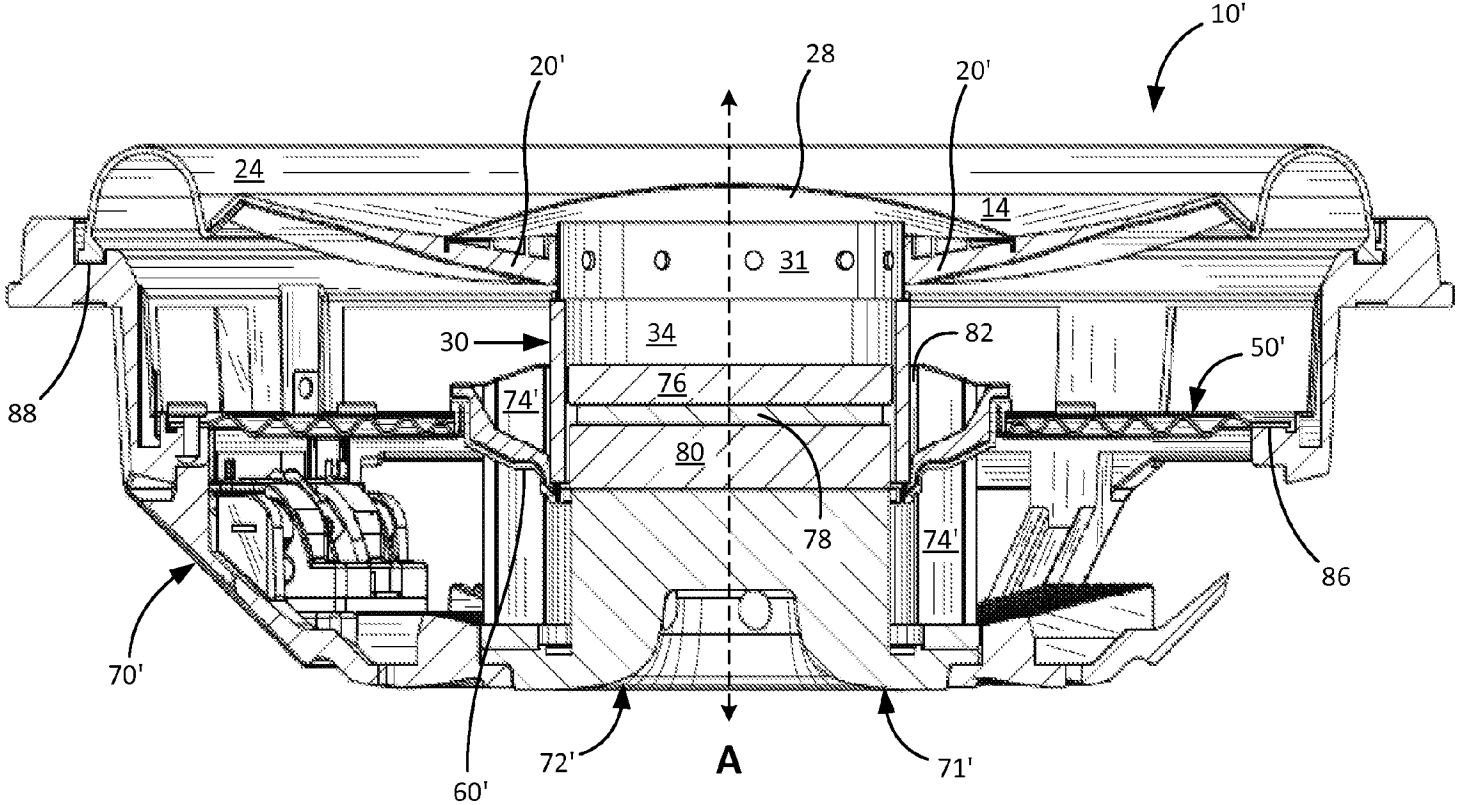
FIG. 4 is another non-exploded cut-away view of a low profile speaker in accordance with the preferred embodiment of FIG. 3 wherein the section line is taken through the yoke sidewall slots.
Figure 5:
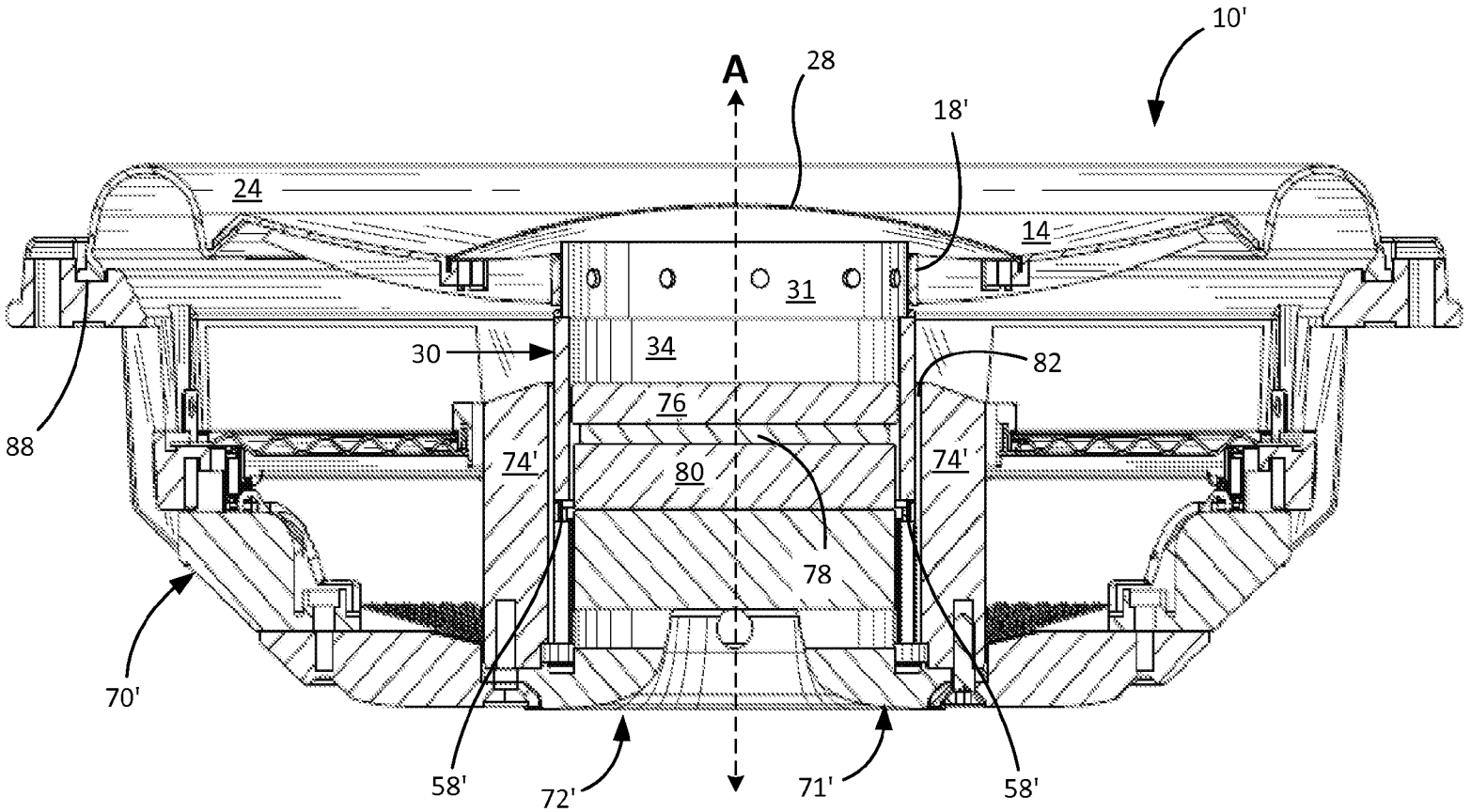
FIG. 5 is another non-exploded cut-away view of a low profile speaker in accordance with the preferred embodiment of FIGS. 3 and 4 wherein the section is taken through the yoke sidewall.

It is first noted that the loudspeaker 10 depicted in FIGS. 1 and 2 is substantially identical to the loudspeaker 10' depicted in FIGS. 3 through 5 except for the specific structures indicated as being minor variants by the use of primed reference numerals in FIGS. 3-5. Further, all structural elements operate/function in a substantially identical manner. Accordingly, loudspeakers 10 and 10' will be discussed jointly immediately below. Unless otherwise noted, all structures and materials are conventional and known to those of ordinary skill.

With joint reference to all of FIGS. 1 through 5, there is shown therein various cut-away views (exploded and non-exploded) of low profile speakers 10 and 10' in accordance with first and second preferred embodiments of the present invention. As shown, a first low profile loudspeaker 10 has a rigid frame 70, a magnetic yoke 71, a voicecoil 30, a resilient surround 24 affixed to frame 70, a spider 50, and a rigid cone 12. The magnetic yoke 71 may be affixed to and/or at least partially integrally molded into frame 70 and may have a slotted sidewall 74 and a central slug 72 disposed within the slotted sidewall to thereby form an air-gap 82 therebetween. At least one of the slotted sidewall 74 and the central slug 72 of the yoke 71 may be permanently magnetic such that the sidewall 74 and central slug 72 form a magnetic circuit. As shown, slots 84 of the slotted sidewall 74 are preferably symmetrically disposed about a central permanently magnetic slug 72 (with the preferred magnet structure being opposing neodymium magnets 76 and 80 with field plate 78 made of low-carbon steel therebetween to focus the magnetic field across air-gap 82. Other functionally equivalent arrangements will occur to those of ordinary skill. For example, central slug 72 may be a magnetically permeable material if (at least) some portion of the slotted sidewall 74 is a permanent magnet.

The invention may also have a voicecoil 30 that is at least partially disposed within the air-gap 82 and has a generally cylindrical former 31, with top 36 and bottom 38 edges, inner and outer surfaces, and a first winding 32 disposed on the outer surface. The voicecoil 30 may move within the air-gap 82 in response to an alternating electrical potential being received by the first winding 32. Such motion is ideally reciprocal motion in the direction of axis A under the influence of amplified signals in the audio frequency range (or, in the case of certain subwoofers, some frequencies lower than an audible frequency range) as is well known and understood in the loudspeaker art. If an optional second winding 34 is used on the inner surface of former 31, it will preferably also drive voicecoil 30 in response to receipt of an alternating electrical potential.

As shown, winding 32 and winding 34 (if used) are spaced inwardly of the bottom and top edges of the former 31 to accommodate affixation of channel 58 and inner ring 18 and to accommodate optional plural apertures as shown throughout. Former 31 and first/second windings 32/34 preferably have substantially uniform (+/−0.005") thicknesses and air-gap 82 is only slightly larger (+/−0.005") than the combined thickness T3 of former 31 and first and second windings 32/34. Optionally, voicecoil 30 and other components may be protected from premature wear from debris with the use of a conventional dust cap 28 as is known in the art. Additionally, cap 28 serves as a radiating wave barrier. First and second windings 32/34 are preferably insulated copper, aluminum, copper-clad, or other non-ferrous electrical conductors that are tightly wound and glued onto the former. Windings 32/34 are preferably of equal and uniform thickness. Former 31 may be made of any of the many known materials including aluminum, KAPTON™, brass, or other known thin/non-ferrous/lightweight materials. Since rigidity and heat tolerance are among the primary design qualities desired in this application aluminum is the preferred former material.

Voicecoil former 31 preferably has plural apertures 40, 42 extending therethrough in the vicinity of the top 36 and bottom 38 edges, respectively. Apertures 40, 42 may extend up to the very edge of former 31 (e.g., FIG. 7) and/or may be located within the periphery of former 31 (e.g., FIG. 1). Importantly, apertures 40 and 42 are preferably located so as to be positioned within the area of engagement with rings 18 and 58. In particular, it has been newly discovered that the use of apertures as shown herein permits improved adhesive affixation which, in turn, improves mechanical coupling, and overall performance.

The spider 50 of the invention may have at least one flexible outer portion 52 affixed to the rigid frame 70 at spider attachment lip 86 and a rigid inner portion 54 affixed to the bottom edge 38 of the voicecoil former 31. The inner portion 54 of the spider 50 may comprise an inner ring 58 disposed in the air-gap 82 between the slotted sidewall 74 and the central slug 72 of yoke 71, an outer ring 56 disposed outside of the slotted sidewall 74 of the yoke, and plural rigid members 60 coupling the inner ring 58 to the outer ring 56 and always extending through the sidewall slots 84. The flexible outer portion 52 of the spider 50 preferably comprises a flexible material having a plurality of alternating and concentric peaks and valleys that flex in response to movement of voicecoil 30. Flexible portion 52 of the spider 50 may be formed of known structures and/or materials such as NOMEX™, polycotton, TPE, TPU, blended materials, thermoplastic elastomers, etc. Rigid inner portion 54 is preferably formed of a rigid material such as plastics, aluminum, alloys, and/or composites. Spider members 60/58 are the preferred means, extending through the sidewall slots 84, for receiving the voicecoil former 31.

It will be noted by those of ordinary skill that, despite the fact that spider 50 moves in the direction of axis A throughout the normal range of linear operation, rigid members 60 of spider 50 are always disposed within slots 84 of slotted sidewall 74. By contrast, rigid members 20 of cone 12 are not disposed within slots 84 when loudspeaker 10 is a rest. Further, rigid members 20 of cone 12 will typically move into and out of slots 84 during normal of linear operation of loudspeaker 10 (assuming the amplitude of the alternating electrical potential is sufficiently large).

Optimally, inner ring 58 is a U-shaped channel with a bottom that connects right and left sidewalls of substantially uniform (+/−0.005") thickness. Further, channel 58 is optimally configured and dimensioned relative to the inner and outer coil windings 32 and 34 and to the air-gap 82 to provide enhanced former-affixation and stability without reducing performance due to trade-offs. For example, the thickness T4 of the former 31 substantially equals (+0.000"/−0.010") the thickness T4 of the channel 58 bottom and the thickness T2 minus T4 of first winding 32 is substantially equal (+0.010"/−0.000") to the thickness of any one of the channel sidewalls. Further, the height of the sidewalls of channel 58 is preferably substantially equal (+/−0.005") to the distance between the bottom 38 of the former and the lower of the two windings 32 and 34. Similarly, the height of ring 18 of inner portion 13 is substantially equal (+/−0.005") to the distance between the top 36 of the former and the higher of the two windings 32 and 34. Also, the combined thickness T3 of windings 32, 34 and of former 31 is substantially equal (+0.010"/−0.000") to the overall width of channel 58. Finally, the thickness of ring 18 is substantially equal (+0.000"/−0.010") to that of winding 32 and the combined thickness T2 of former 31 and ring 18 is substantially the same (+/−0.005") as the combined thickness of former 31 and winding 32.

Channel 58 is preferably adhered to the bottom edge 38 of the voicecoil former 31 with a conventional adherent such that former apertures 42 are enclosed by the U-shaped channel and such that the adherent contacts channel 58, the inner and outer former surfaces, and former apertures 42. Similarly, ring 18 is preferably adhered to the top edge 36 of the voicecoil former 31 with a conventional adherent such that former apertures 40 are covered by ring 18 and such that the adherent contacts ring 18, the outer former surface, and former apertures 40.

Finally, the rigid cone 12 may have an inner portion 13 affixed to the top edge 36 of the voicecoil former 31 and an outer portion 14 affixed to the resilient surround 24 (which is, in turn, affixed to frame 70 along surround-engagement lip 88). The cone inner portion 13 may include a rigid inner ring 18 capable of movement within air-gap 82 of the yoke, a rigid outer ring 16 disposed outside of the slotted sidewall 74 of the yoke 71, and plural rigid members 20 coupling the inner ring 18 to the outer ring 16, the rigid members 20 being capable of movement within the sidewall slots 84 in response to movement of the voicecoil 30. While surround 24 may be formed of any one of the many known materials such as flexible foam (polyester, polyurethane), PTE, PTU, rubber and/or cloth. Rigid inner portion 13 is preferably formed of a rigid material such as plastics, aluminum, alloys, and/or composites. Likewise, rigid outer portion 14 of cone 12 is preferably formed of a rigid material such as plastics, aluminum, alloys, and/or composites. Members 20 and ring 18' of inner portion 13 and ring 58 and members 60 of inner portion 54 are the preferred means for receiving the voicecoil former 31.

Figure 6:
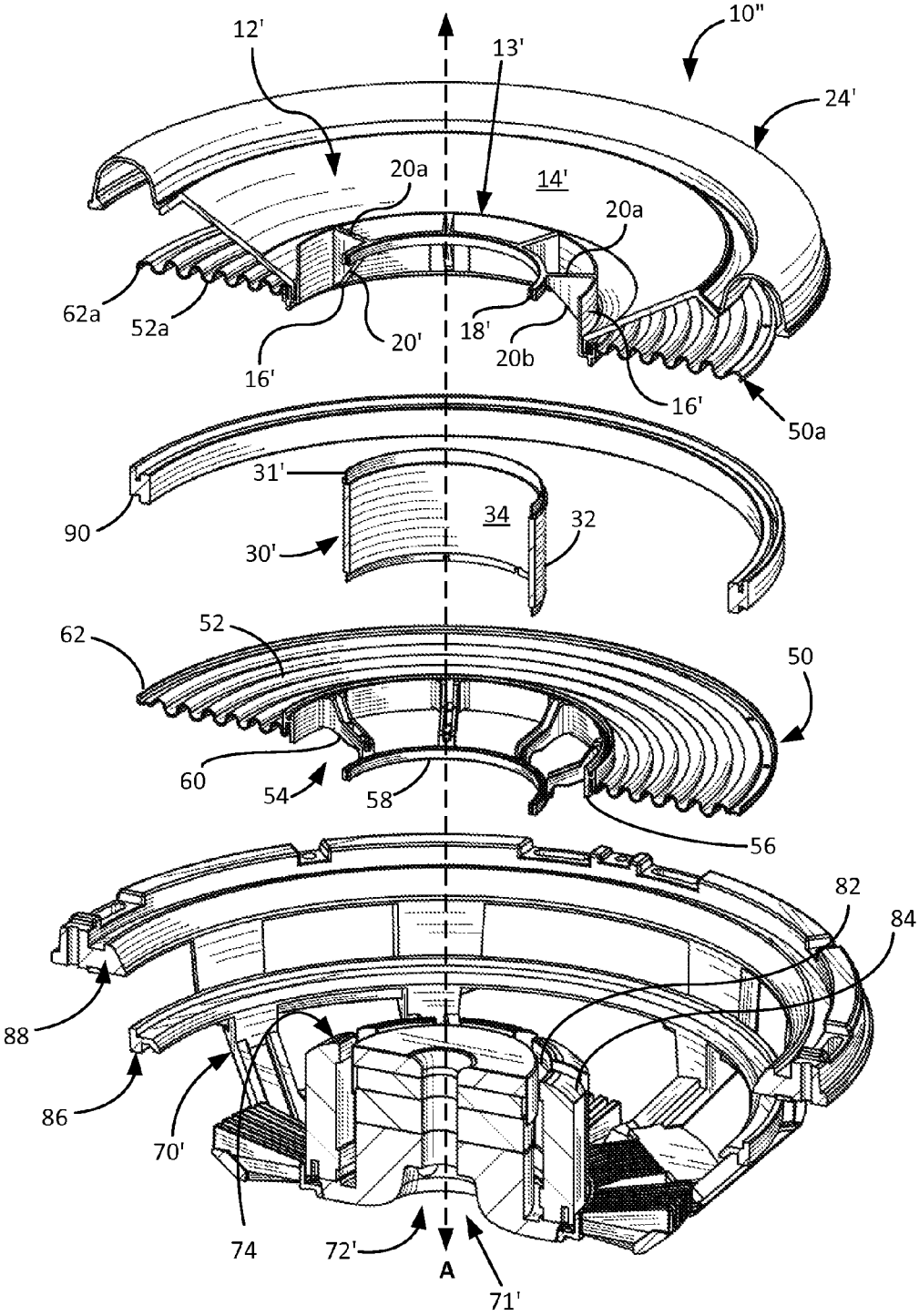
FIG. 6 is an exploded cut-away view of a low profile speaker having two spiders and being in accordance with a third preferred embodiment of the present invention.
Figure 7:
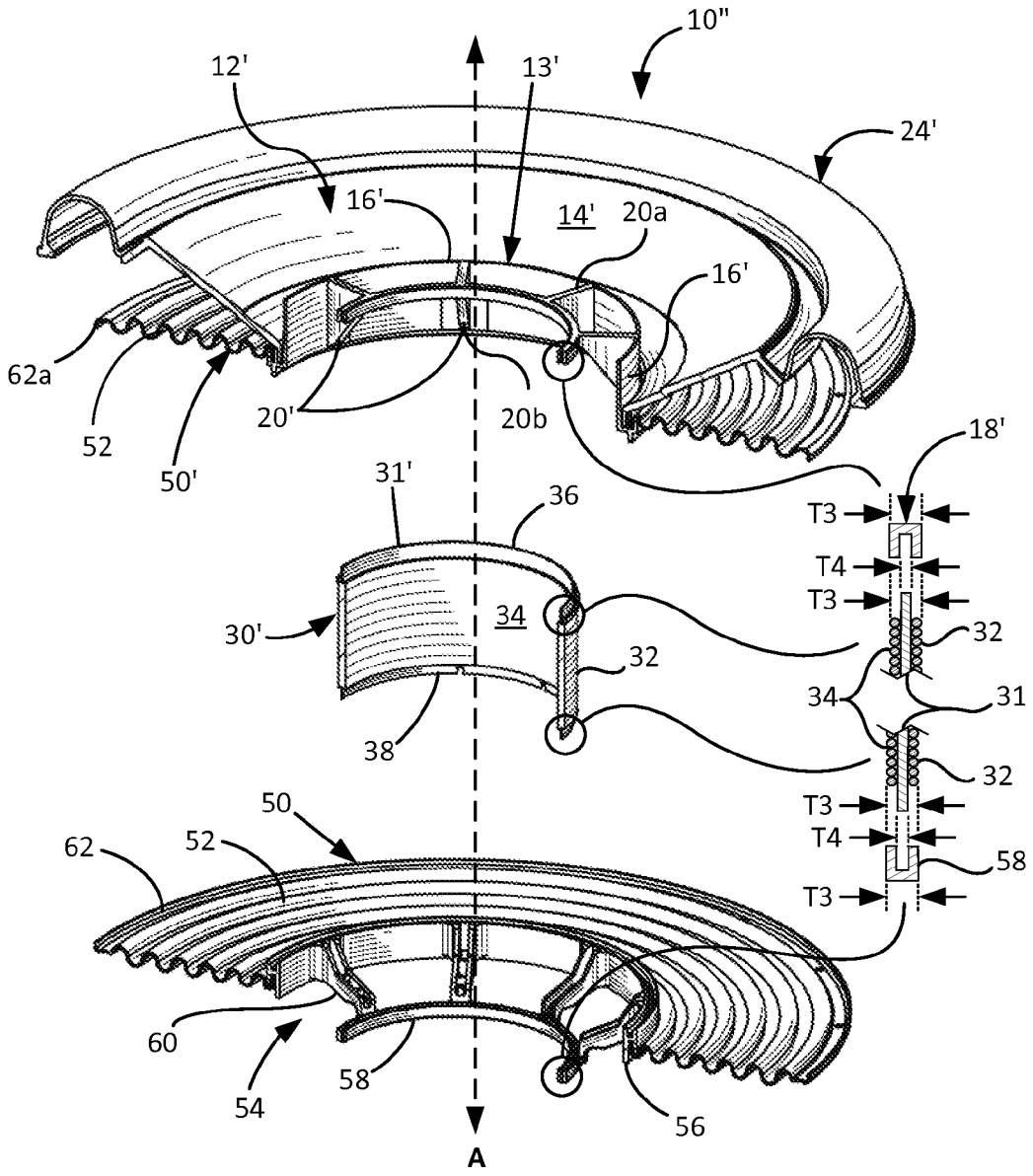
FIG. 7 is an exploded cut-away view of the cone, first and second spiders, and the voicecoil of the low profile speaker of FIG. 6.

Turning now to the alternative embodiment of FIGS. 6 and 7, those of ordinary skill will readily appreciate that loudspeaker 10" is similar to loudspeakers 10 and 10' of FIGS. 1 through 5. Accordingly, a description of the common elements thereof will generally not be repeated and the new elements will be described in detail below.

As shown in FIGS. 6 and 7 an alternative form of the present invention preferably includes a loudspeaker 10" with a first spider 50 that is identical to that shown in FIGS. 3-5 but also employs a flexible second spider **50*a* affixed between rigid frame 70' and the rigid inner portion 13' of the cone 12'. Second spider 50*a* is preferably substantially identical in materials and structure as that of outer portion 52 of (first) spider 50. The embodiment of FIGS. 6 and 7 may also include a rigid cone 12' comprising an inner portion 13' affixed to the top edge of voicecoil former 31' and an outer portion 14' affixed to the resilient surround 24'. The inner portion 13' of the cone 12' may have plural rigid members 20' capable of movement within the sidewall slots 84 in response to movement of the voicecoil 30'. As shown, the tops 20*a* of rigid members 20' are at least substantially perpendicular to axis A and the bottoms 20*b* of rigid members 20' preferably slope down as one moves outwardly from axis A. Outer ring 16' is taller compared to that of outer ring 16 of FIGS. 1-5. The geometry of ring 16' and members 20' provides a desirably light structure while still providing the requisite rigidity/strength and not substantially interfering with permissible travel for cone 12'** in use.

At outer edges 62 and **62*a*, spiders 50 and 50*a* are affixed to and spaced apart by rigid spacer 90, which may be considered part of frame 70' when speaker 10" is fully assembled. In particular, edge 62 is affixed to lip 86 with spacer 90 affixed on top of that and edge 62*a* is affixed to the top of spacer 90. Together they are all rigidly fixed to frame 70'**.

Those of skill will notice that compared to slug 72, slug 72' includes an aperture extending therethrough. This difference permits slightly better air-flow and is a conventional design choice. Those of skill will also notice that outer ring 16' and outer ring 56 have substantially identical (+/−0.005") diameters such that they rigidly engage one another in a fully assembled loudspeaker 10". Since former 31, inner spider portion 54 and inner cone portion 13' are all rigid, they collectively form a remarkably light and rigid structure. Since, in this preferred embodiment, the inner ring 58 of spider 50 and the inner ring 18' of the cone 12' are axially-aligned and confronting U-shaped channels (in cross-section) that have substantially identical diameters (+/−0.005"), former 31 is rigidly disposed therebetween. In this way, the former, the inner portion of the spider, and the inner portion of the cone are affixed to each other such that they are rigidly connected together (a conventional adhesive may be used) and one traditional weak point is greatly improved. In particular, the voicecoil affixation joints are greatly improved because they are less susceptible to spider and/or cone flexure in use. This is a direct result of the "cage structure" of the assembled former 31, inner spider portion 54, and inner cone portion 13'. In particular, the three primary factors contributing to this effect are (1) rigid outer rings 56 and 16' reducing flexure; (2) members 60 and 20' reducing flexure; and (3) the trapping of former 31' between inner portions 54 and 16'.

Ideally, the overall thickness T3 of the spider channel 58 and the thickness T3 of the cone channel 18' are no greater than the combined thickness T3 of the former, the first winding, and the second winding. When this is the case, all of the benefits noted above are achieved with very little trade-off because, for example, the air-gap 82 does not need to be enlarged to accommodate the former-engaging U-shaped channels 58 and/or 18'. Further, channel 58 is preferably adhered to the bottom edge 38 of the voicecoil former 31 with an adherent such that former apertures 42 are enclosed by the U-shaped channel such that the adherent contacts channel 58, the inner and outer former surfaces, and former apertures 42. Similarly, ring 18' is preferably adhered to the top edge 36 of the voicecoil former 31 with an adherent such that former apertures 40 are covered by ring 18' and such that the adherent contacts ring 18', the inner and outer former surface, and former apertures 40.

As shown in FIG. 7, the overall thickness T3 of spider channel 58 and the overall thickness T3 of the cone channel 18' are preferably no greater than the combined thicknesses of the former, the first winding, and the second winding. Optimally, channel 58 and channel 18' are configured and dimensioned relative to the inner and outer coil windings 32 and 34 and to the air-gap 82 to provide enhanced former affixation and stability without reducing performance due to trade-offs. For example, the thickness T4 of former 31 substantially equals (+/−0.005") the thickness T4 of the bottom of both channels 58 and 18'. Further, the thickness T2 minus T4 of first winding 32 is substantially equal (+0.010"/−0.000") to the thickness of any one of the channel sidewalls. Further, the height of the sidewalls of channel 58 are preferably substantially equal (+0.000"/−0.010") to the distance between the bottom 38 of the former and the lower of the two windings 32 and 34. Similarly, the height of the sidewalls of channels 18' are substantially equal (+0.000"/−0.010") to the distance between the top 36 of the former and the higher of the two windings 32 and 34. Also, the combined thickness T3 of windings 32, 34 and of former 31 is substantially equal (+0.010"/−0.000") to the overall width of channels 18' and 58.

Members 20' and ring 18' of inner portion 13' and members 60 and ring 58 of inner portion 54 are the preferred means for receiving the voicecoil former 31'.

As with the flexible outer portion 52 of first spider 50, flexible second spider 50' preferably comprises a flexible material (NOMEX™, polycotton, TPE, TPU, blended materials, thermoplastic elastomers, etc.) having a plurality of alternating and concentric peaks and valleys. Alternatively, the flexible portion 52 of the spider 50 may be formed of known structures and/or materials.

Figure 8:
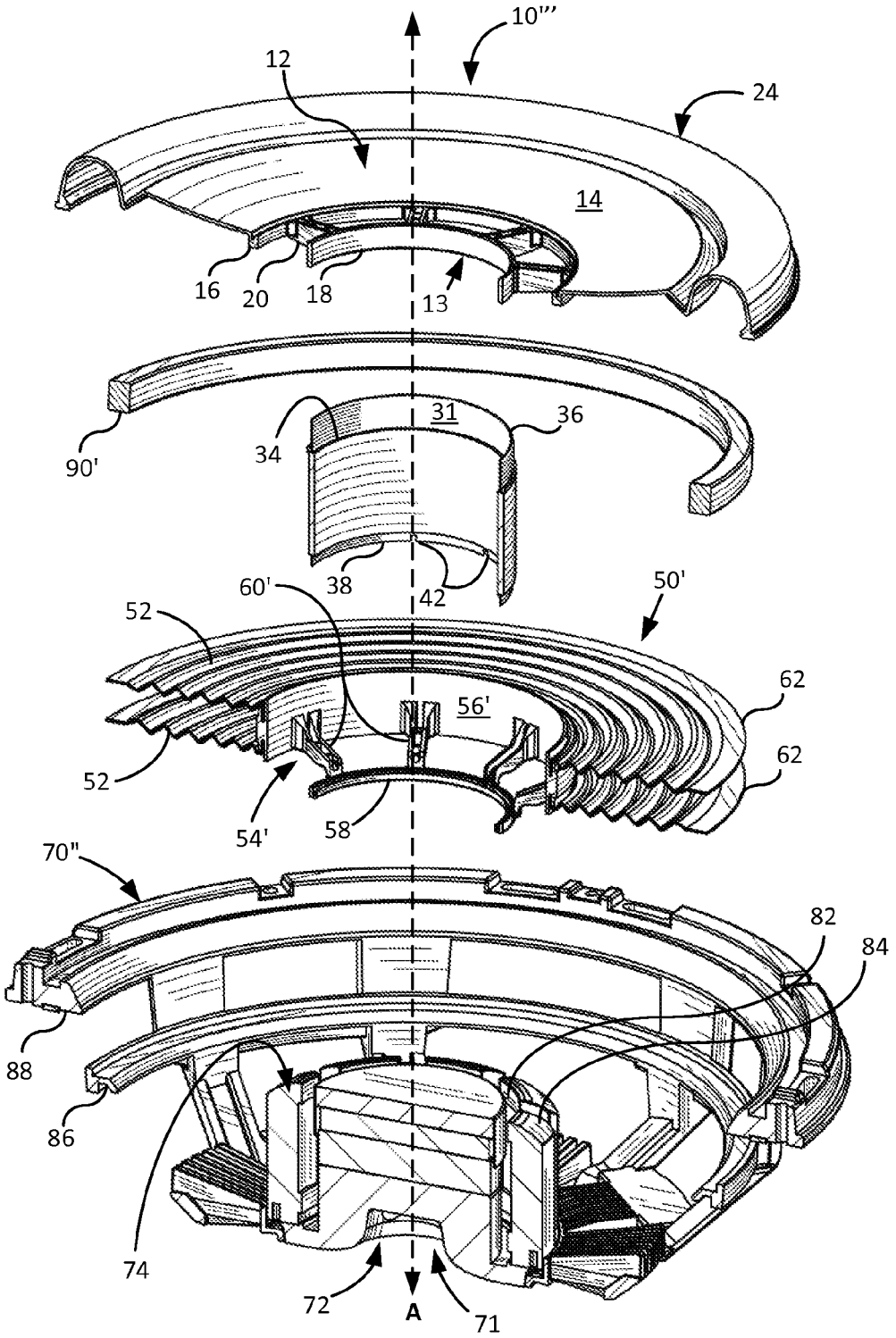
FIG. 8 is an exploded cut-away view of a low profile speaker having a dual-spider and being in accordance with a fourth preferred embodiment of the present invention.
Figure 9:
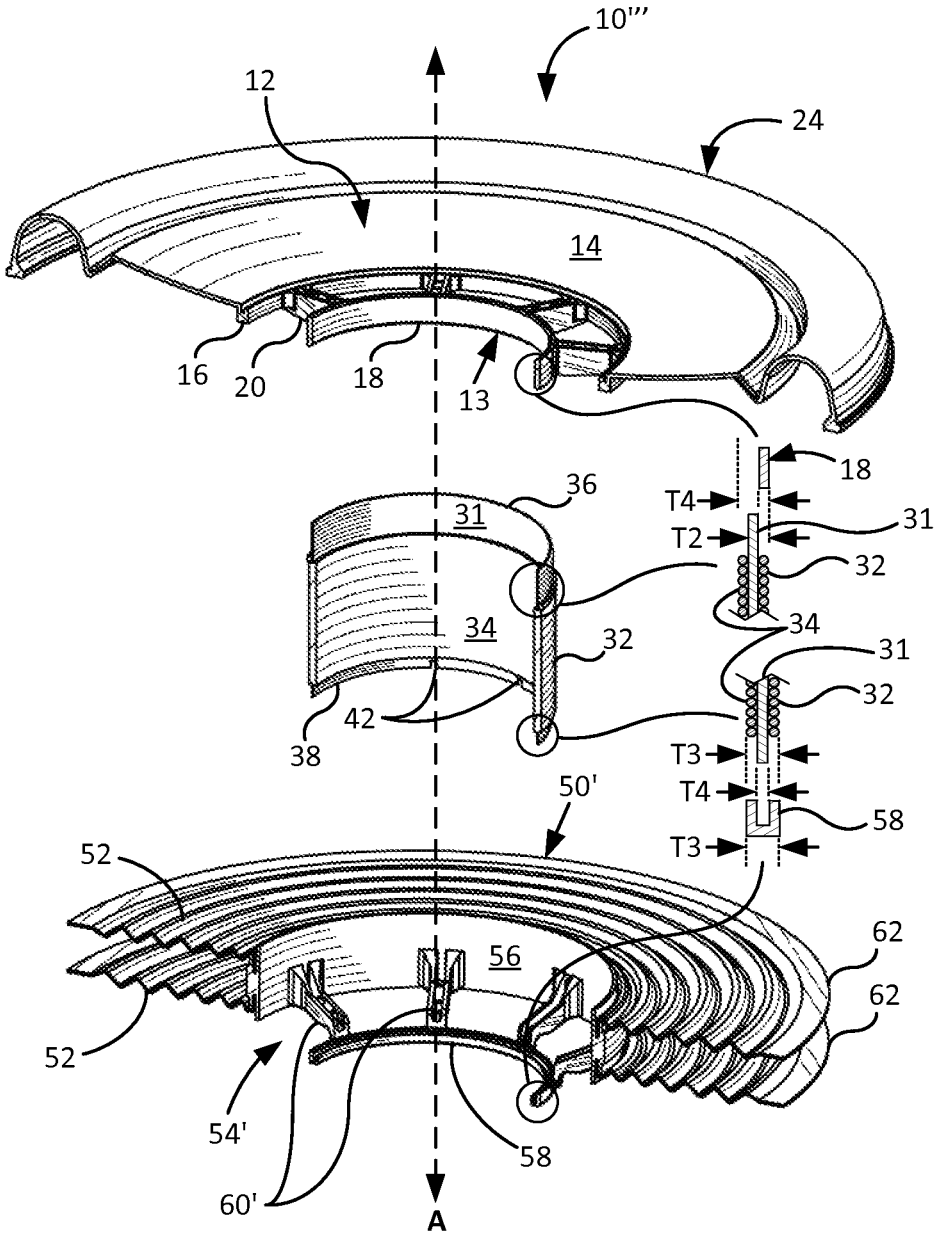
FIG. 9 is an exploded cut-away view of the cone, the dual-spider, and the voicecoil of the low profile speaker of FIG. 8.

With reference now to the alternative embodiment of FIGS. 8 and 9, those of ordinary skill will readily appreciate that loudspeaker 10' is similar to all of loudspeakers 10, 10', and 10" of FIGS. 1 through 7. Accordingly, a description of the common elements thereof will generally not be repeated and the new elements will be described in detail below.

FIGS. 8 and 9 show that another alternative form of the invention may include a speaker 10'" having a dual-spider 50' having identical first and second flexible outer portions 52 and 52 affixed between rigid frame 70" and a rigid inner portion 54'. The inner portion 54' of spider 50' may be affixed to the bottom edge 38 of voicecoil former 31 and may have plural rigid members 60' that always extend through respective ones of the sidewall slots 84. Also, speaker 10' may have a rigid cone 12 that is substantially similar to that shown and described with respect to FIGS. 1 through 5. At outer edges 62, spider outer portions 52 are affixed to and spaced apart by rigid spacer 90, which may be considered part of frame 70" when speaker 10' is fully assembled. In particular, one edge 62 is affixed to lip 86 with spacer 90 affixed on top of that and the other edge 62 is affixed to the top of spacer 90. Together they are all rigidly fixed to frame 70". As with the flexible outer portion 52 of first spider 50, the second flexible outer portion 52 of dual-spider 50' preferably comprises a flexible material (such as NOMEX™, polycotton, TPE, TPU, blended materials, etc.) having a plurality of alternating and concentric peaks and valleys. Alternatively, the flexible portions 52 of dual-spider 50' may be formed of other known structures and/or materials. Inner portion 54' of dual-spider 50' is preferably formed of any of the rigid materials discussed above with respect to inner portions 54, 16, and/or 16'. Members 20 and ring 18 of inner portion 13 and ring 58 and members 60' of inner portion 54' are the preferred means for receiving the voicecoil former 31.

While the present invention has been described in connection with what is presently considered to be the most practical and preferred embodiments, it is to be understood that the invention is not limited to the disclosed embodiments, but is intended to encompass the various modifications and equivalent arrangements included within the spirit and scope of the appended claims. With respect to the above description, for example, it is to be realized that the optimum dimensional relationships for the parts of the invention, including variations in size, materials, shape, form, function and manner of operation, assembly and use, are deemed readily apparent to one skilled in the art, and all equivalent relationships to those illustrated in the drawings and described in the specification are intended to be encompassed by the appended claims. Therefore, the foregoing is considered to be an illustrative, not exhaustive, description of the principles of the present invention.

Other than in the operating examples or where otherwise indicated, all numbers or expressions referring to quantities of ingredients, reaction conditions, etc. used in the specification and claims are to be understood as modified in all instances by the term "about." Accordingly, unless indicated to the contrary, the numerical parameters set forth in the following specification and attached claims are approximations that can vary depending upon the desired properties, which the present invention desires to obtain. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical values, however, inherently contain certain errors necessarily resulting from the standard deviation found in their respective testing measurements.

Also, it should be understood that any numerical range recited herein is intended to include all sub-ranges subsumed therein. For example, a range of "1 to 10" is intended to include all sub-ranges between and including the recited minimum value of 1 and the recited maximum value of 10; that is, having a minimum value equal to or greater than 1 and a maximum value of equal to or less than 10. Because the disclosed numerical ranges are continuous, they include every value between the minimum and maximum values. Unless expressly indicated otherwise, the various numerical ranges specified in this application are approximations.

For purposes of the description hereinafter, the terms "upper", "lower", "right", "left", "vertical", "horizontal", "top", "bottom", and derivatives thereof shall relate to the invention as it is oriented in the drawing figures. However, it is to be understood that the invention may assume various alternative variations and step sequences, except where expressly specified to the contrary. It is also to be understood that the specific devices and processes illustrated in the attached drawings, and described in the following specification, are simply exemplary embodiments of the invention. Hence, specific dimensions and other physical characteristics related to the embodiments disclosed herein are not to be considered as limiting.

What is claimed is:

1. A low profile loudspeaker comprising:

a rigid frame;

a magnetic yoke affixed to the rigid frame and comprising a slotted sidewall and a central slug disposed within the slotted sidewall to thereby form an air-gap therebetween, at least one of the slotted sidewall and the central slug being permanently magnetic such that the sidewall and central slug form a magnetic circuit;

a voicecoil that is at least partially disposed within the air-gap, the voicecoil comprising a generally cylindrical former, with top and bottom edges and an inner and outer surfaces, and a first winding disposed on one of the inner and outer surfaces, the voicecoil moving within the air-gap in response to an alternating electrical potential being received by the first winding;

a spider having at least one flexible outer portion affixed to the rigid frame and a rigid inner portion affixed to the bottom edge of the voicecoil former, the inner portion of the spider comprising an inner ring disposed between the slotted sidewall and the central slug of the yoke, an outer ring disposed outside of the slotted sidewall of the yoke, and plural rigid members coupling the inner ring to the outer ring and always extending through the sidewall slots;

a resilient surround affixed to the rigid frame; and a rigid cone comprising an inner portion affixed to the top edge of the voicecoil former and an outer portion affixed to the resilient surround, the inner portion of the cone comprising a rigid inner ring capable of movement between the slotted sidewall and the central slug of the yoke, a rigid outer ring disposed outside of the slotted sidewall of the yoke, and plural rigid members coupling the inner ring to the outer ring, wherein the rigid members are capable of movement within the sidewall slots in response to movement of the voicecoil.

2. The loudspeaker of claim 1, wherein the first winding is disposed on the outer surface of the former.

3. The loudspeaker of claim 2, further comprising a second winding disposed on the inner surface of the former, the second winding moving within the air-gap in response to an alternating electrical potential being received by both of the first and second windings.

4. The loudspeaker of claim 1, wherein the inner ring of the spider and the inner ring of the cone are axially aligned and have substantially identical diameters such that the former is disposed therebetween.

5. The loudspeaker of claim 1, wherein the outer ring of the spider and the outer ring of the cone are axially aligned, have substantially identical diameters, and are affixed to each other such that the former, the inner portion of the spider, and the inner portion of the cone are rigidly connected together.

6. The loudspeaker of claim 1, wherein the flexible outer portion of the spider comprises a flexible material having a plurality of alternating and concentric peaks and valleys.

7. The loudspeaker of claim 1, wherein the plural rigid members of the spider always extend through respective ones of the sidewall slots, wherein the plural rigid members of the cone always extend through respective ones of the sidewall slots, and wherein the rigid members of the spider and of the cone move within respective ones of the sidewall slots in response to movement of the voicecoil.

8. The loudspeaker of claim 1, wherein slots of the slotted sidewall are symmetrically disposed about the central magnetic slug of the yoke.

9. A low profile loudspeaker comprising:

a rigid frame;

a magnetic yoke affixed to the rigid frame and comprising a slotted sidewall and a central magnetic slug disposed within the slotted sidewall to thereby form an air-gap therebetween;

a voicecoil that is at least partially disposed within the air-gap, the voicecoil comprising a generally cylindrical former, with top and bottom edges and an inner and outer surfaces, and a first winding disposed on one of the inner and outer surfaces, the voicecoil moving within the air-gap in response to an alternating electrical potential being received by the first winding;

a first spider having a flexible outer portion and a rigid inner portion, the outer portion being affixed between the frame and the inner portion and the inner portion being affixed to the bottom edge of the voicecoil former, the inner portion comprising plural rigid members always extending through the sidewall slots;

a resilient surround affixed to the rigid frame;

a rigid cone comprising an inner portion affixed to the top edge of the voicecoil former and an outer portion affixed to the resilient surround, the inner portion of the cone comprising plural rigid members capable of movement within the sidewall slots in response to movement of the voicecoil; and a flexible second spider affixed between the rigid frame and the rigid inner portion of the cone.

10. The loudspeaker of claim 9, wherein the first winding is disposed on the outer surface of the former.

11. The loudspeaker of claim 10, further comprising a second winding disposed on the inner surface of the former, the voicecoil moving within the air-gap in response to an alternating electrical potential being received by both of the first and second windings.

12. The loudspeaker of claim 9, wherein the rigid inner portion of the first spider further comprises an inner ring disposed within the air-gap of the yoke and an outer ring disposed outside of the slotted sidewall of the yoke, and wherein the plural rigid members couple the inner ring to the outer ring.

13. The loudspeaker of claim 12, wherein the inner portion of the cone further comprises a rigid inner ring capable of movement within the air-gap and a rigid outer ring disposed outside of the slotted sidewall, and wherein the plural rigid members couple the inner ring to the outer ring; and the inner ring of the first spider and the inner ring of the cone are axially aligned and have substantially identical diameters such that the former is disposed therebetween.

14. The loudspeaker of claim 13, wherein the outer ring of the spider and the outer ring of the cone are axially aligned, have substantially identical diameters, and are affixed to each other such that the former, the inner portion of the spider, and the inner portion of the cone are rigidly connected together.

15. The loudspeaker of claim 9, wherein the outer portion of the first spider and the second spider comprise a flexible material having a plurality of alternating and concentric peaks and valleys.

16. The loudspeaker of claim 9, wherein slots of the slotted sidewall are symmetrically disposed about the central magnetic slug of the yoke.

17. A low profile loudspeaker comprising:

a rigid frame;

a magnetic yoke affixed to the rigid frame and comprising a slotted sidewall and a central slug disposed within the slotted sidewall to thereby form an air-gap therebetween, at least one of the slotted sidewall and the central slug being permanently magnetic such that the sidewall and central slug form a magnetic circuit;

a voicecoil that is at least partially disposed within the air-gap, the voicecoil comprising a generally cylindrical former, with top and bottom edges and an inner and outer surfaces, and a first winding disposed on one of the inner and outer surfaces, the voicecoil moving within the air-gap in response to an alternating electrical potential being received by the first winding;

a dual spider having first and second flexible outer portions affixed between the rigid frame and a rigid inner portion, the inner portion of the spider being affixed to the bottom edge of the voicecoil former and comprising plural rigid members that always extend through respective ones of the sidewall slots;

a resilient surround affixed to the rigid frame; and a rigid cone comprising an inner portion affixed to the top edge of the voicecoil former and an outer portion affixed to the resilient surround for movement in response to movement of the voicecoil, the inner portion of the cone comprising plural rigid members capable of movement within respective ones of the sidewall slots in response to movement of the voicecoil.

18. The loudspeaker of claim 17, wherein the inner portion of the spider further comprises an inner ring disposed within the air-gap of the yoke, an outer ring disposed outside of the slotted sidewall of the yoke, and plural rigid members coupling the inner ring to the outer ring and always extending through the sidewall slot, wherein the inner portion of the cone further comprises a rigid inner ring capable of movement within the air-gap of the yoke, and a rigid outer ring disposed outside of the slotted sidewall of the yoke.

19. The loudspeaker of claim 17, wherein the outer ring of the spider and the outer ring of the cone are axially aligned, have substantially identical diameters, and are affixed to each other such that the former, the inner portion of the spider, and the inner portion of the cone are rigidly connected together.

20. The loudspeaker of claim 17, wherein the first and second outer portions of the spider each comprises a flexible portion affixed between the rigid inner portion of the spider and the frame and formed of flexible material having a plurality of alternating and concentric peaks and valleys.

* * * * *